United States Patent [19]

Rein

[11] Patent Number: 4,679,796

[45] Date of Patent: Jul. 14, 1987

[54] PROBLEM SOLVING GAME

[75] Inventor: Harold Rein, 33 Fifth Ave., New York, N.Y. 10003

[73] Assignee: Harold Rein et al, New York, N.Y.

[73] Assignee: Harold Rein, New York, N.Y.

[21] Appl. No.: 795,855

[22] Filed: Nov. 7, 1985

[51] Int. Cl.[4] ..... A63F 3/00; A63B 71/00

[52] U.S. Cl. ..... 273/236; 273/148 R; 273/148 A; 273/DIG. 26

[58] Field of Search ..... 273/148 R, 148 A, 296, 273/236, 274, 242, 249, 243, 280; 40/27.5

[56] References Cited

U.S. PATENT DOCUMENTS

| | | | |
|---|---|---|---|
| 2,801,855 | 8/1957 | Clay et al. | 273/236 |
| 3,306,462 | 2/1967 | Da Cruz | 40/27.5 |
| 3,674,274 | 7/1972 | Schur | 273/280 |
| 3,939,578 | 2/1976 | Coffey | 273/243 |
| 4,095,799 | 6/1978 | Stringer | 273/236 |
| 4,124,214 | 11/1978 | Pavis | 273/249 |
| 4,273,337 | 6/1981 | Carrera et al. | 273/243 |
| 4,315,627 | 2/1982 | Schlegel et al. | 273/249 |
| 4,487,418 | 12/1984 | Allen | 273/242 |

*Primary Examiner*—Richard C. Pinkham
*Assistant Examiner*—Benjamin Layno
*Attorney, Agent, or Firm*—McAulay, Fields, Fisher, Goldstein & Nissen

[57] ABSTRACT

A game in which players gain points by correctly solving problems depicted on cards in a chart-like format. The cards are divided into three cards sets according to three different levels of difficulty. Six vertical columns each having a plurality of slots for receiving chips are used for keeping track of each player's score. Each player is assigned a vertical column. The six vertical columns are each divided into three areas corresponding to the three card sets. Players progress during the game by correctly solving problems and inserting chips. The card set from which a players must choose a card is determined by the column area the player has progressed to. The first player to earn a predetermined number of points wins the game. The solution to each problem and clues to aid in solving each problem are provided.

5 Claims, 27 Drawing Figures

FIG. 2
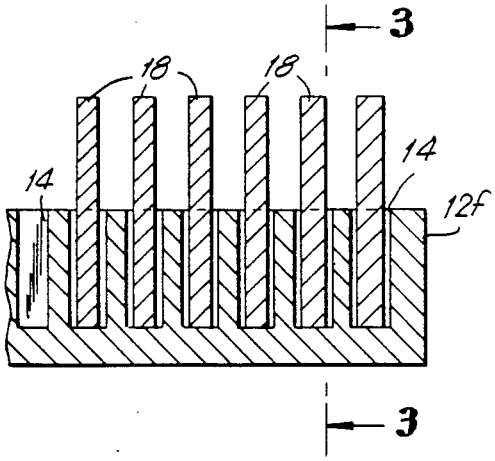
FIG. 3
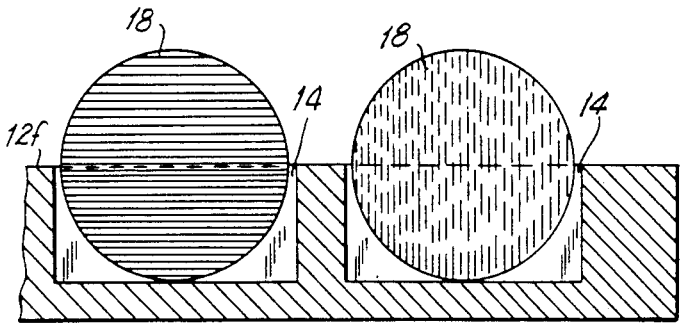
FIG. 4
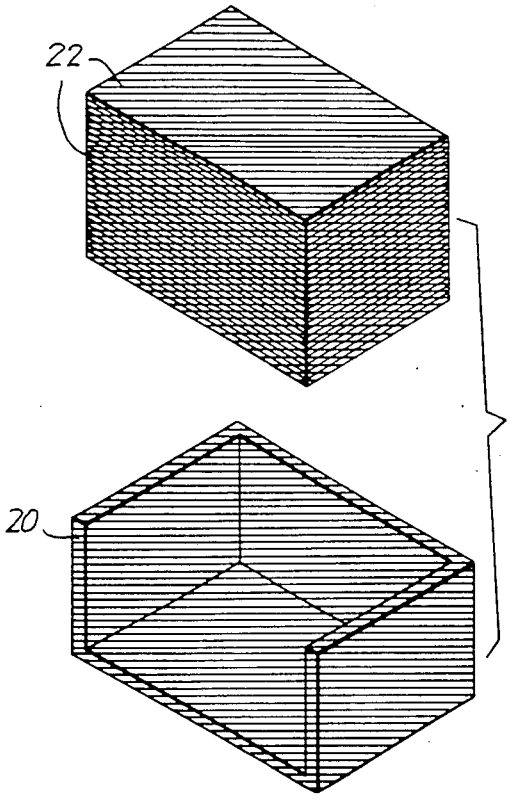
SCORING
| | |
|---|---|
| CORRECT ANSWER | + 10 |
| CORRECT ANSWER WITH FIRST CLUE | + 5 |
| CORRECT ANSWER WITH SECOND CLUE | NO GAIN-NO LOSS |
| NO ANSWER/ WRONG ANSWER | − 5 |
| BOOMER | + 10 |
| BUSTER | −10 |
| UPTICK | + 5 |
| DOWNTICK | − 5 |
FIG. 5

22

How many miles from "Motown" to "Beantown"?

| NO CLUES | BIRMINGHAM, ALA. | BOSTON MASS. | BUFFALO N.Y. | CHICAGO ILL. | CLEVELAND OHIO | DALLAS TEX. | DENVER COL. |
|---|---|---|---|---|---|---|---|
| DETROIT, MICH. | 754 | 702 | 252 | 279 | 175 | 1,167 | 1,301 |
| EL PASO, TEX. | 1,278 | 2,358 | 1,928 | 1,439 | 1,746 | 625 | 652 |
| INDIANAPOLIS, IND. | 492 | 940 | 510 | 189 | 318 | 872 | 1,051 |
| LOS ANGELES, CA. | 2,078 | 3,036 | 2,606 | 2,112 | 2,424 | 1,425 | 1,174 |
| MIAMI, FLA. | 777 | 1,539 | 1,445 | 1,390 | 1,325 | 1,332 | 2,094 |
| NEW YORK, N.Y. | 983 | 213 | 436 | 840 | 514 | 1,604 | 1,780 |
| WASHINGTON, D.C. | 751 | 440 | 386 | 695 | 369 | 1,372 | 1,635 |

22

What's the name of this state?

PROBLEM SOLVING GAME

BACKGROUND OF THE INVENTION

This invention in general relates to the solution of problems by deductive reasoning and more particularly to a game which presents various problems, in chart form, to be solved by deductive reasoning.

Many games which use a playing board are known in the art. Some of these games, in addition to having amusement value, serve an educational purpose. For example, the well known game "Trivial Pursuit" in addition to being entertaining, tests, and possibly increases players' knowledge of various facts. Manufacturers of games are constantly looking for new games to entertain and educate.

The major purpose of this invention is to provide a game which is entertaining and, further, which helps to develop the players' powers of deductive reasoning.

BRIEF DESCRIPTION OF THE INVENTION

In brief, the invention resides in a game which presents players with problems, in chart-like format, to be solved by deductive reasoning. The game also includes clues to aid in the solving of the problems and in reaching the solutions to the problems. Means are provided to associate each problem with its respective clues and solution.

The problems are presented on challenge cards and three different sets of challenge cards are provided. The three card sets present problems of different levels of difficulty. Each player begins with the card set containing the easiest problems and moves up to the second set containing the middle level problems. The player finally moves to the card set which has the problems that are the most difficult and challenging to solve. By correctly solving the problems presented on the cards players earn points.

In addition to challenge cards the game includes bonus and penalty cards which are randomly distributed among the challenge cards. The bonus and penalty cards, when picked up during normal course of play, provide the player whose turn it is with a predetermined bonus or penalty. The player is not given a problem to solve when a bonus or penalty card is presented during his turn.

The winner of the game is the first player to score a predetermined number of points. Points are scored by either correctly solving the problems depicted on challenge cards or by receiving extra points from bonus cards. Appropriate scoring means are utilized to keep track of each player's score.

BRIEF DESCRIPTION OF THE DRAWINGS

In the accompanying drawings:

FIG. 2 is a sectional view taken generally along line 2—2 of FIG. 1 and shows a vertical column of a scoring means for use with the game of the present invention with chips in some of the slots provided in the scoring means.

FIG. 3 is a sectional view taken generally along line 3—3 of FIG. 2.

FIG. 4 is a perspective view showing a set of challenge cards used with the game of the present invention and a holder for these cards.

FIG. 5 is a representation of the scoring directions for the game.

DESCRIPTION OF THE PREFERRED EMBODIMENTS

As shown in the FIGS., game 11 requires players to solve problems which are depicted, in chart-like form, on challenge cards 22. In addition to the problems, game 11 includes clues to aid the players in solving the problems presented on the challenge cards and in reaching the solution to each problem. The problems are a form of visual puzzle. Each visual puzzle, prior to solution, has a piece missing and the correct solution of each problem provides this missing piece.

To win game 11 a player must be the first to obtain a predetermined score. Points are awarded for correctly solving the problems presented on the challenge cards.

Any appropriate scoring means may be used in game 11 to keep track of each player's score. For example, pencil and paper may be used. In a preferred embodiment of game 11, six vertical columns 12*a*, 12*b*, 12*c*, 12*d*, 12*e* and 12*f* and chips 18 are used for scoring. As best shown in FIG. 2, each vertical column is defined by twenty-one slots 14. Slots 14, as shown in FIGS. 2 and 3, are shaped and dimensioned to removably receive chips 18.

Figure 1:
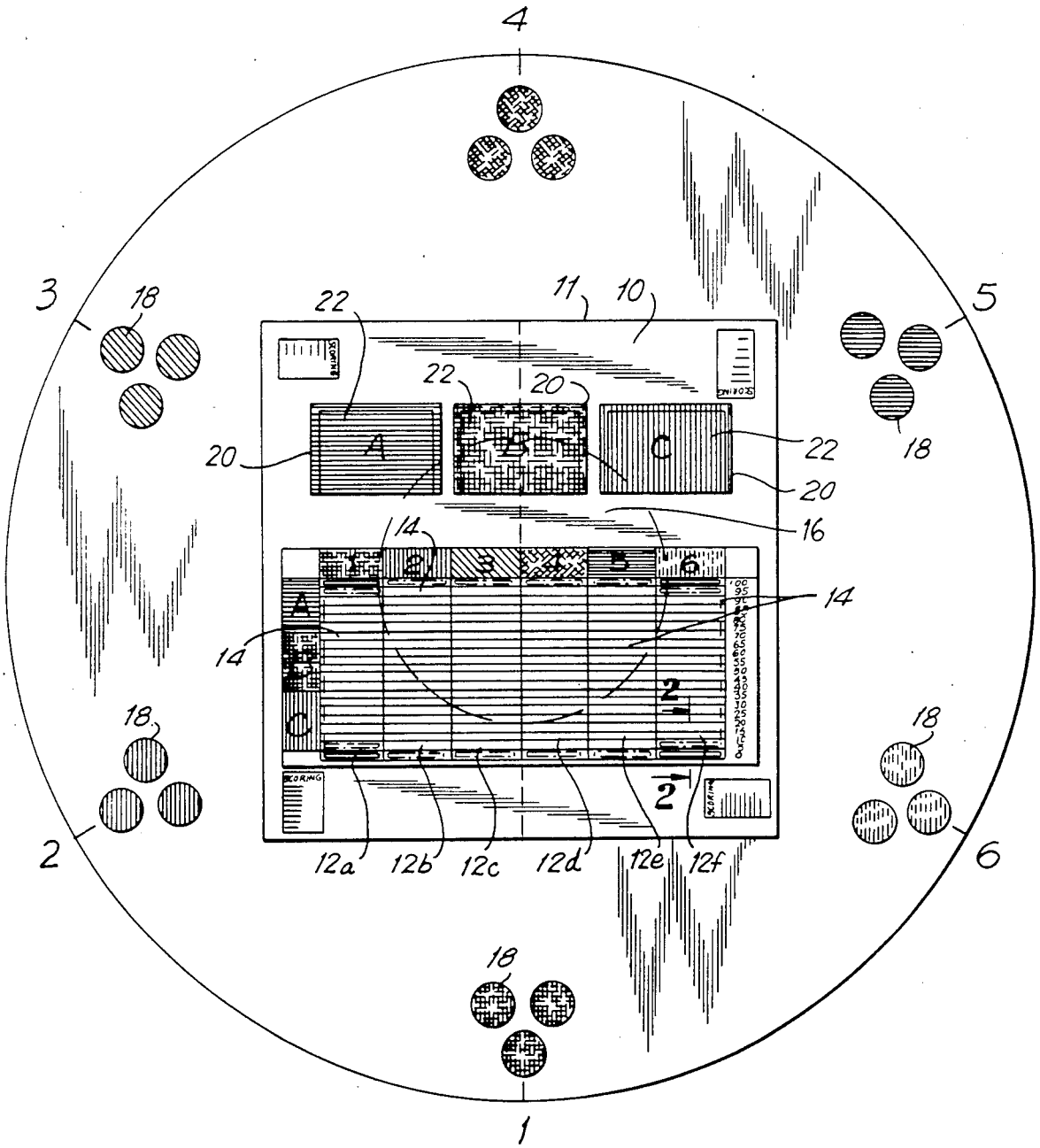
FIG. 1 is a top plan view showing the game board of the present invention set up for play by six players.
Figure 6:
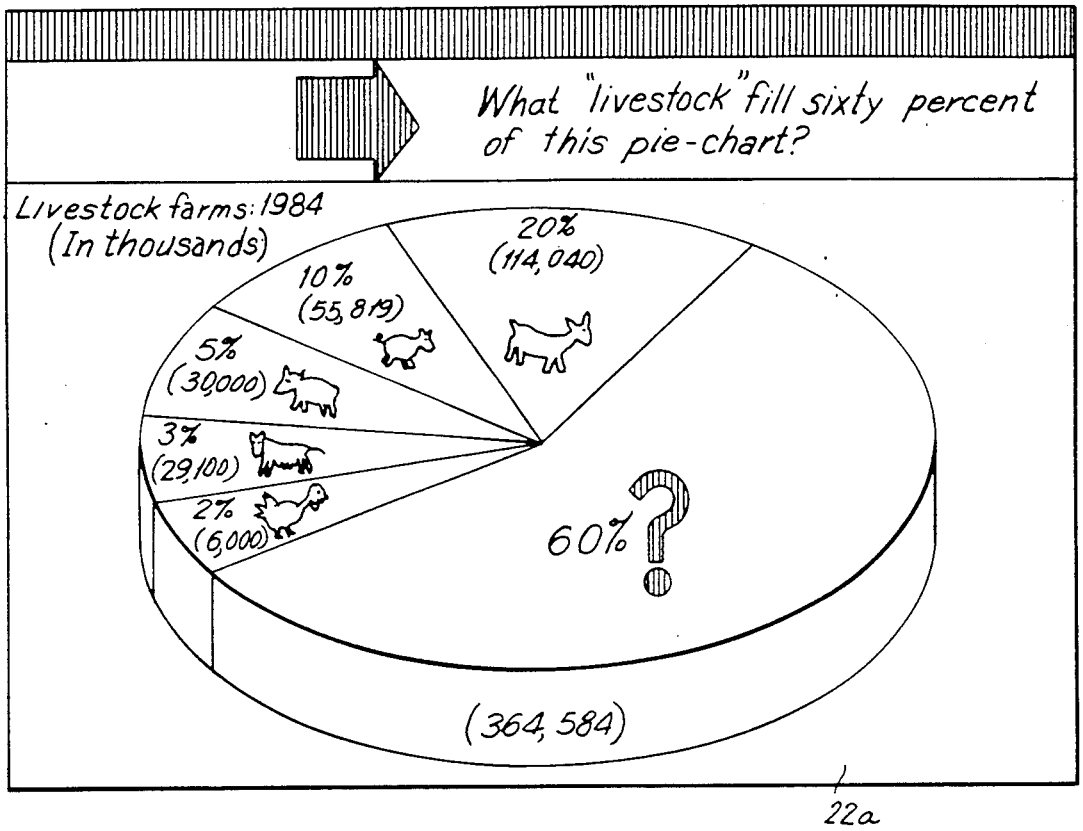
FIG. 6. is a representation of one side of a challenge card showing a problem to be solved by a player in the game.
Figure 7:
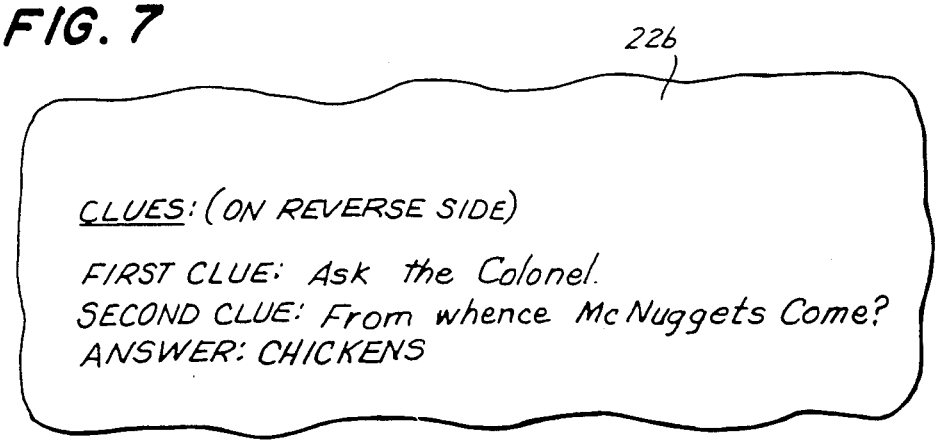
FIG. 7 is a representation of a portion of the opposite side of the FIG. 6 challenge card showing the clues to aid in the solution of the problem presented on the face of the card.
Figure 8:
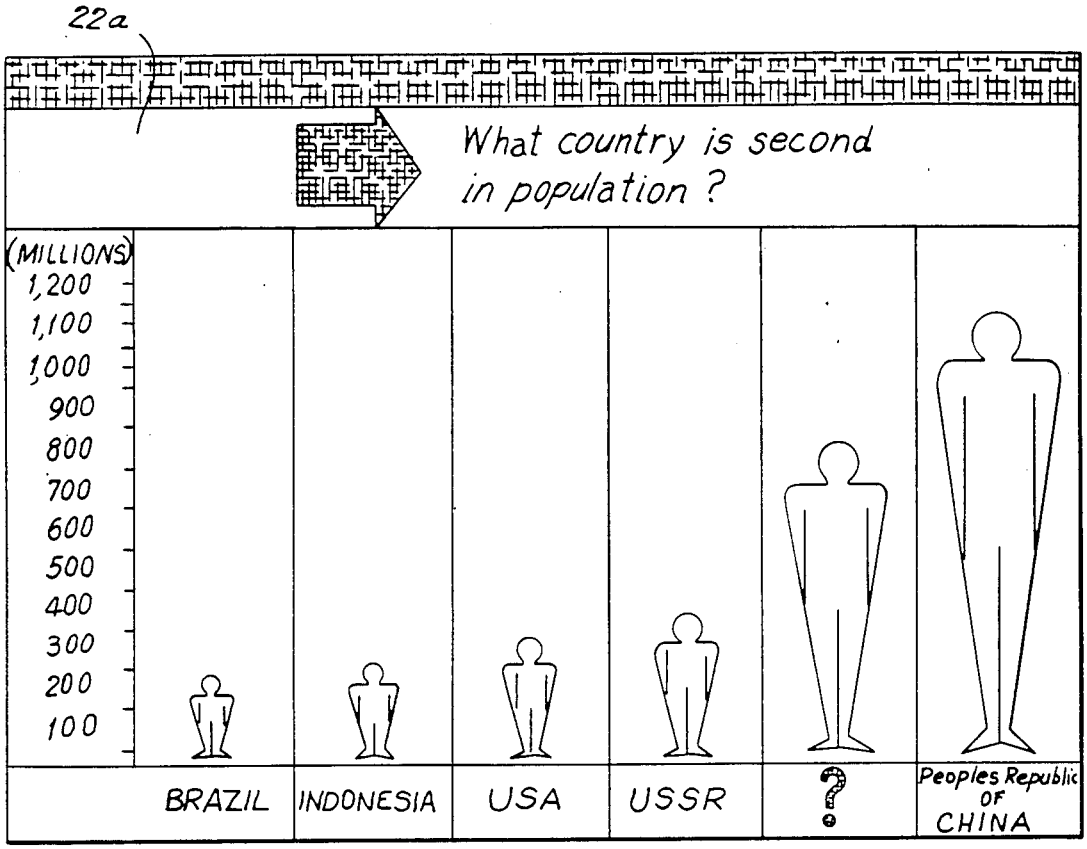
FIG. 8 is analogous to FIG. 6 showing another challenge card with another problem being presented for solution.

The chips when retained in the slots present a visual indication of each player's score. As shown in FIG. 1, game 11 may be played on a game board 10. Game board 10 may be placed upon a small turntable 16 so that the board can be easily rotated during play.

Although any number of players may play game 11, in a preferred embodiment of the game, a maximum of six individual players or any number of players organized into a maximum of six teams may play. This is so that each player or team of players may use one of the six vertical columns to represent his score, when the scoring means is formed with six columns.

The challenge cards 22 are divided into three sets, A, B,and C. Each set of challenge cards can be conveniently held in a card holder 20, as best shown in FIG. 4, sets A, B,and C containing progressively more difficult groups of problems. The challenge cards in set C present easily solved problems. The challenge cards in set A present problems which are difficult to solve. The challenge cards in set B present problems which are more difficult than those in set C but easier than those in set A. In addition to the challenge cards 22, bonus and penalty cards, which are randomly interspersed with the challenge cards, are provided.

In the preferred embodiment of the game, shown in FIG. 1, each vertical column is divided into three areas, A, B, and C which correspond to the three sets of challenge cards. The aim of the game is for a player to be the first one to receive one hundred points. Each chip 18 represents five points, so that when a player earns twenty chips he wins. The twenty chips, when placed in the player's vertical column, fill the column and indicate visually that the player has won the game. As shown in the drawings, each vertical column is defined by twenty-one slots. Twenty slots represent the one hundred points needed to win. The bottom-most slot, the twenty-first, represents a negative score.

As heretofore explained, means are provided to associate each problem with its associated clues and solution. As shown in FIGS. 6–11, this association, in a preferred embodiment of the game, is achieved by depicting the problem to be solved on a first side 22*a* of each card, while depicting the clues and solution to each problem on the second side 22*b* of the card.

When play begins each player is shown problems from the set C cards. After a player has filled in all of the slots in area C of his vertical column with chips, he is shown problems from the set B cards. When he has filled in all of the slots in area B with chips, he is shown problems from set A cards.

As shown in FIG. 1, each column is associated with a different color. The chips are colored to match the column colors. Before play commences, each player chooses a column and gathers at his play position the appropriately colored chips. Each player places one chip, representing five points, in the appropriate slot of his column, generally at the bottom, to begin the game.

Any player may be the first player to start. In one embodiment of the game the player to the left of the starter picks the first challenge card from Set C and presents it to the starter. If the starter correctly solves the problem shown on the card he scores ten points, as indicated on the scoring card in FIG. 5, and adds two chips to his column. If he cannot solve the problem he is given a first clue from the back of the challenge card. If he is then able to deduce the correct answer, he scores five points and adds one chip to his column. If the player cannot deduce the answer after being given the first clue, he is given the second clue. If he then solves the problem his score remains the same; chips are neither added to or removed from his column. If, after being given the second clue the player cannot deduce the correct answer, he loses five points, and a chip is removed from his column. At the beginning of play this is indicated by moving the first chip down into the bottom-most slot of the column. This is then the starting point for the player's next turn. Play proceeds with the second player now being shown a challenge card from Set C by the player to his left. As previously stated, when a player has filled in all of the slots in any area of his column, his next challenge card is drawn from the next set of challenge cards. The same principle applies if a player loses points and moves into a different column area.

Figure 24:
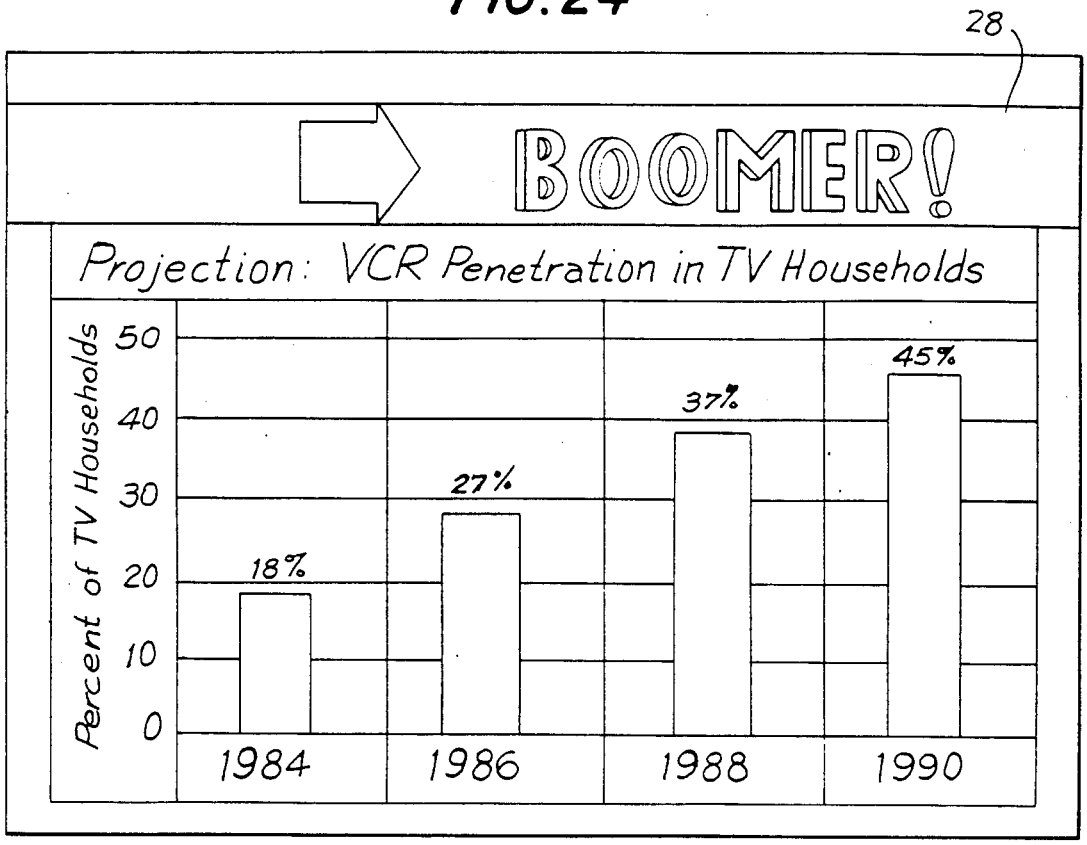
FIG. 24 shows a bonus card for use with the game of the present invention.
Figure 25:
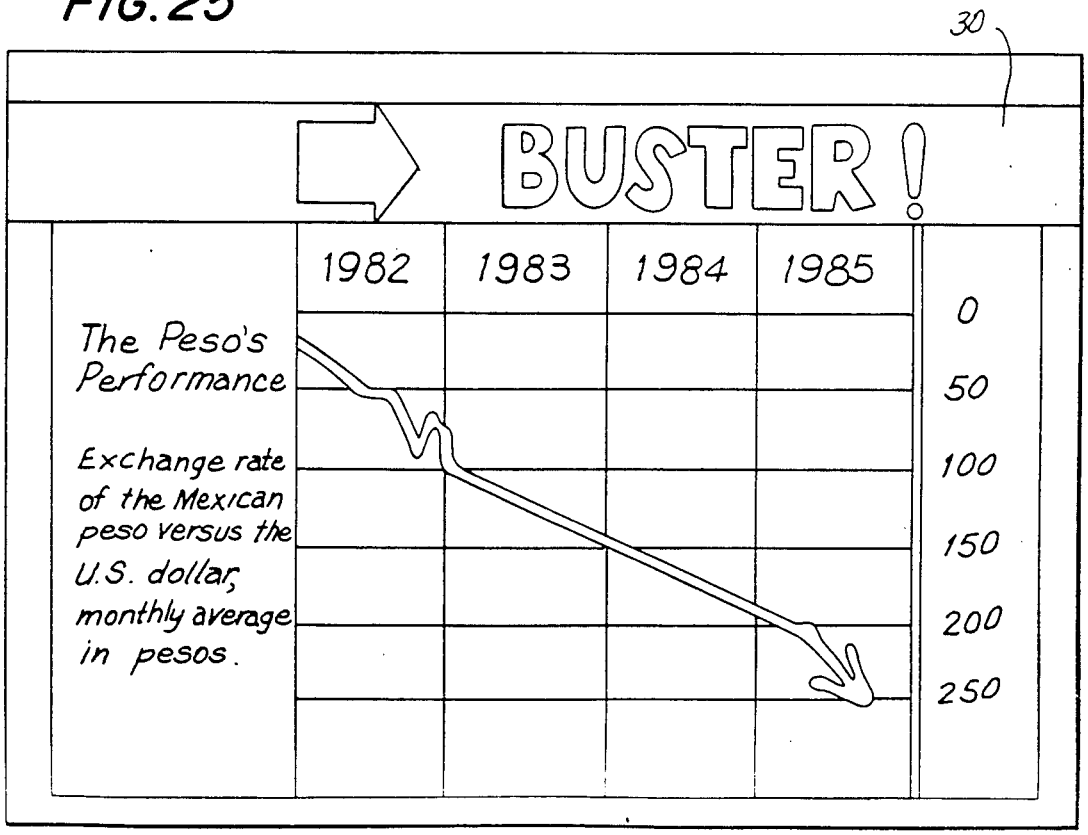
FIG. 25 shows a penalty card for use with the game of the present invention.
Figure 26:
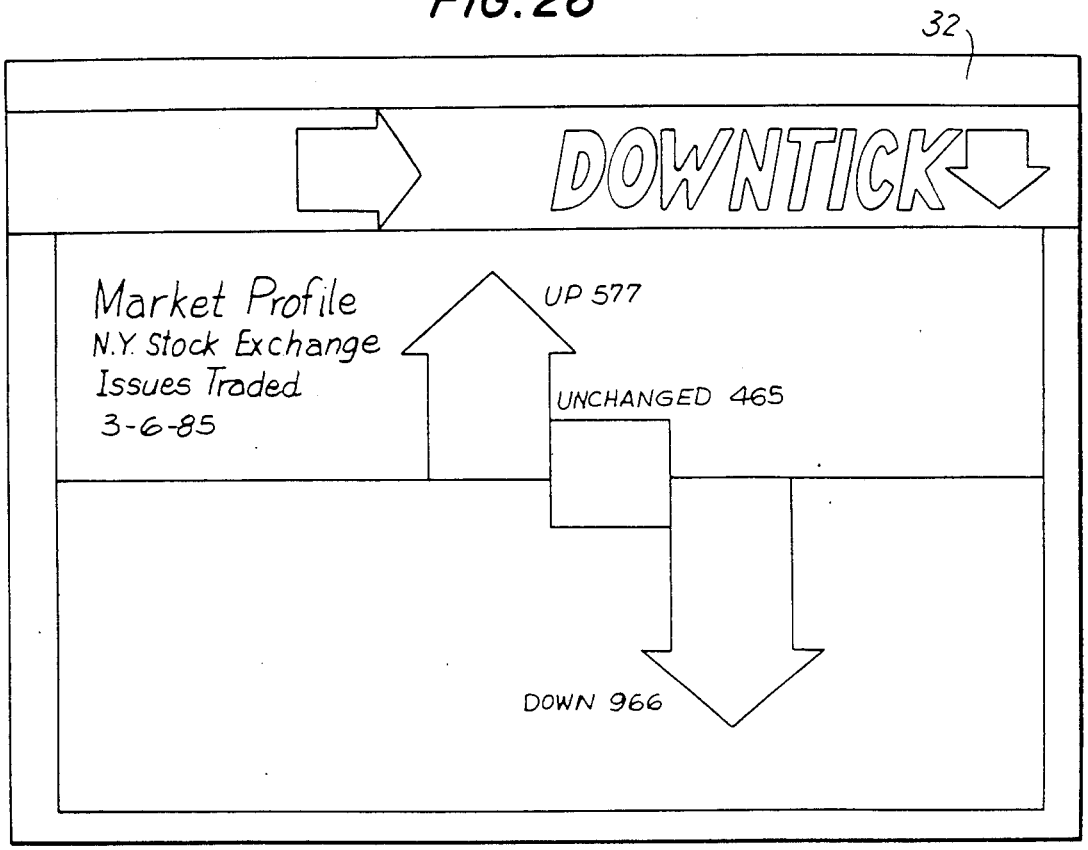
FIG. 26 shows another type of penalty card used with the game of the present invention.
Figure 27:
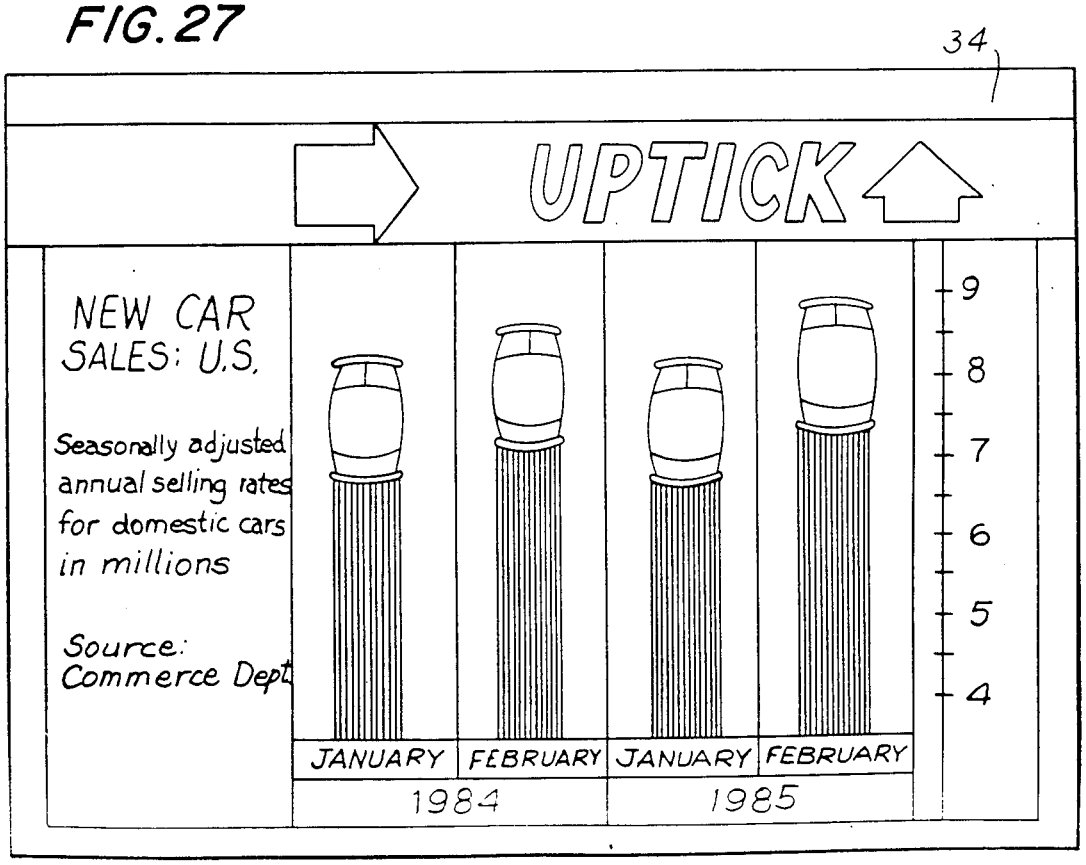
FIG. 27 shows another type of bonus card used with the game of the present invention.

Bonus and penalty cards, shown in FIGS. 24–27, are randomly distributed among the challenge cards. If a Boomer card 28, shown in FIG. 24, is drawn the player is not presented with a problem and the player gains ten points (two chips). If a Buster card 30, shown in FIG. 25, is drawn, no problem is presented and the player loses ten point (two chips). If a Downtick card 32, shown in FIG. 26, is drawn, no problem is presented and the player loses five points (one chip). If an Uptick card 34, shown in FIG. 27, is drawn, no problem is presented and the player gains five points (one chip).

The drawing of a bonus or penalty card counts as a turn. The player is not then presented with a challenge card and a problem.

Although most challenge cards and problems have clues to aid in problem solving, there will be some cards, particularly from Set C, which have no clues. In that case the player must either solve the problem with no aid and gain ten points or lose ten points if he cannot solve the problem unaided.

Figure 9:
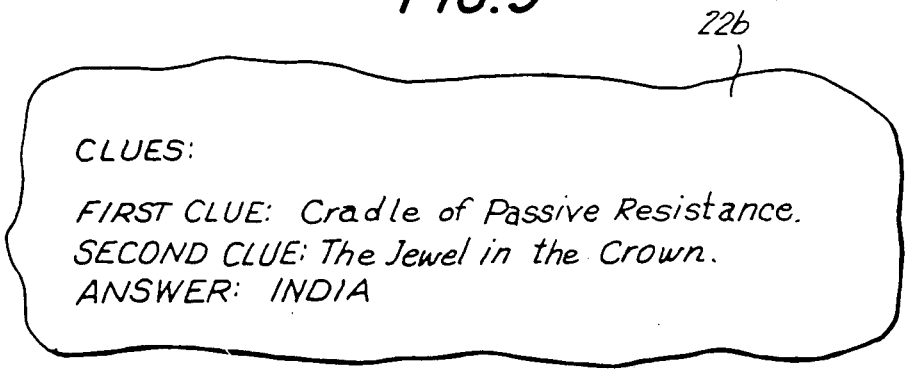
FIG. 9 is analogous to FIG. 7 showing another series of clues and answers to aid in the solution of the problem presented on the face of the FIG. 8 card.
Figure 10:
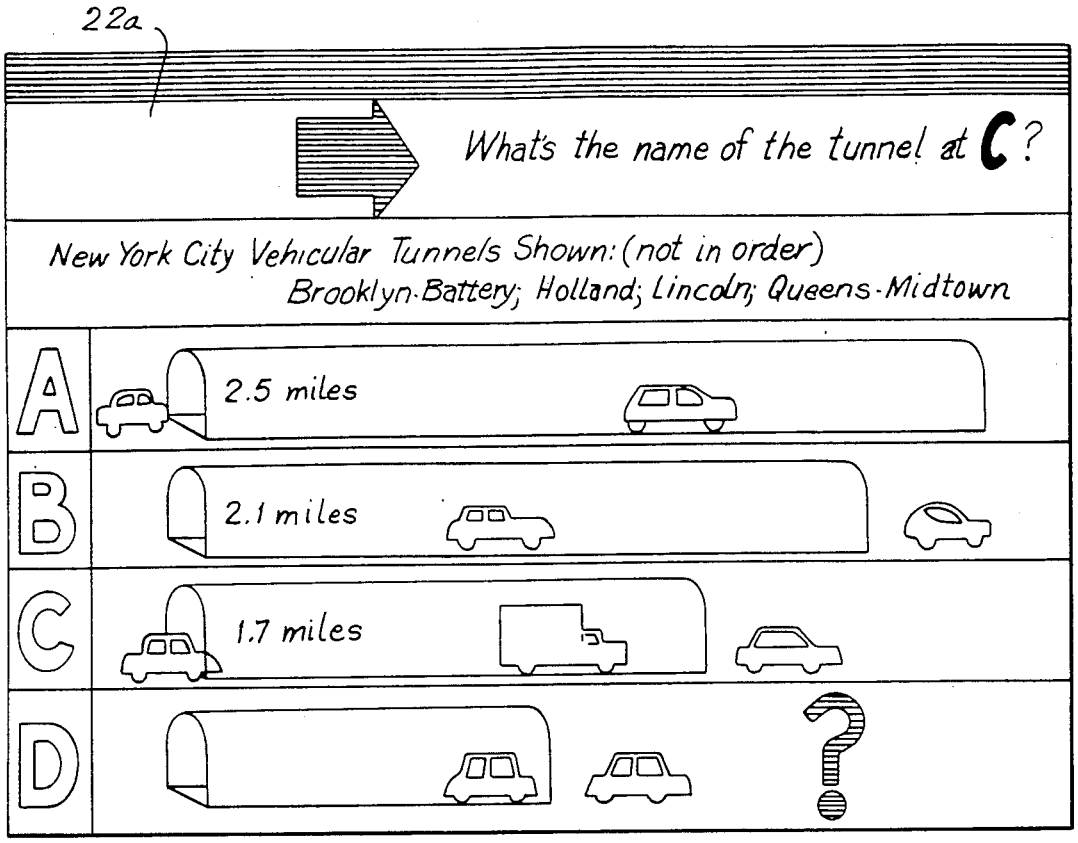
FIG. 10 is analogous to FIG. 6 showing another challenge card with another problem being presented for solution.
Figure 11:
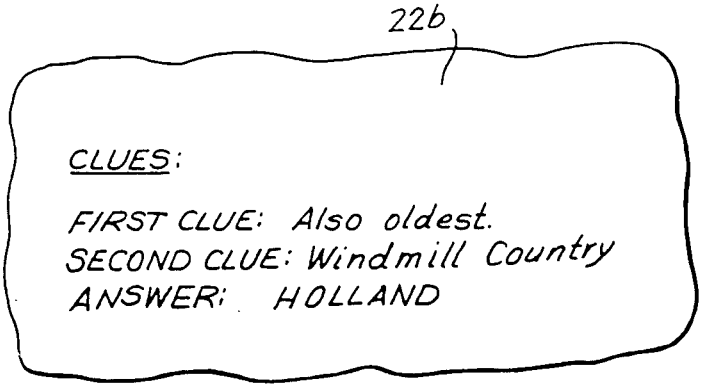
FIG. 11 is analogous to FIG. 7 showing another series of clues to aid in the solution of the problem presented on the face of the FIG. 10 card.
Figure 12:
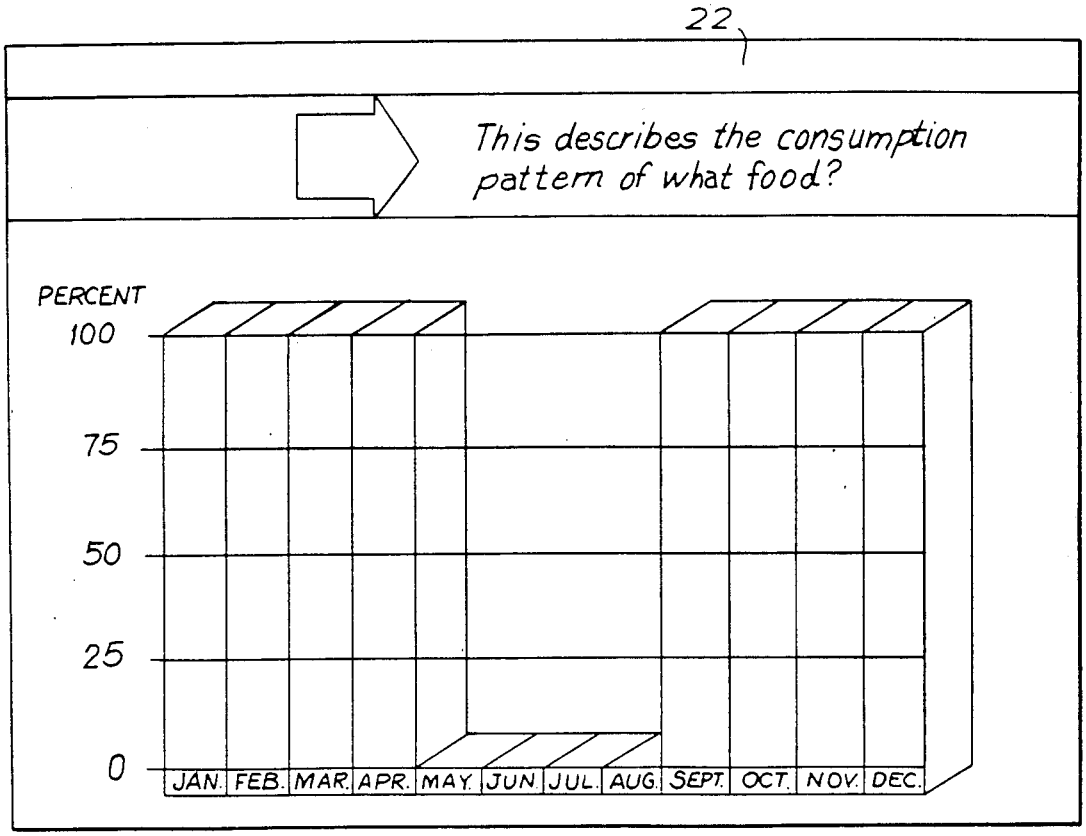
FIG. 12 is analogous to FIG. 6 showing another challenge card with another problem being presented for solution.
Figure 13:
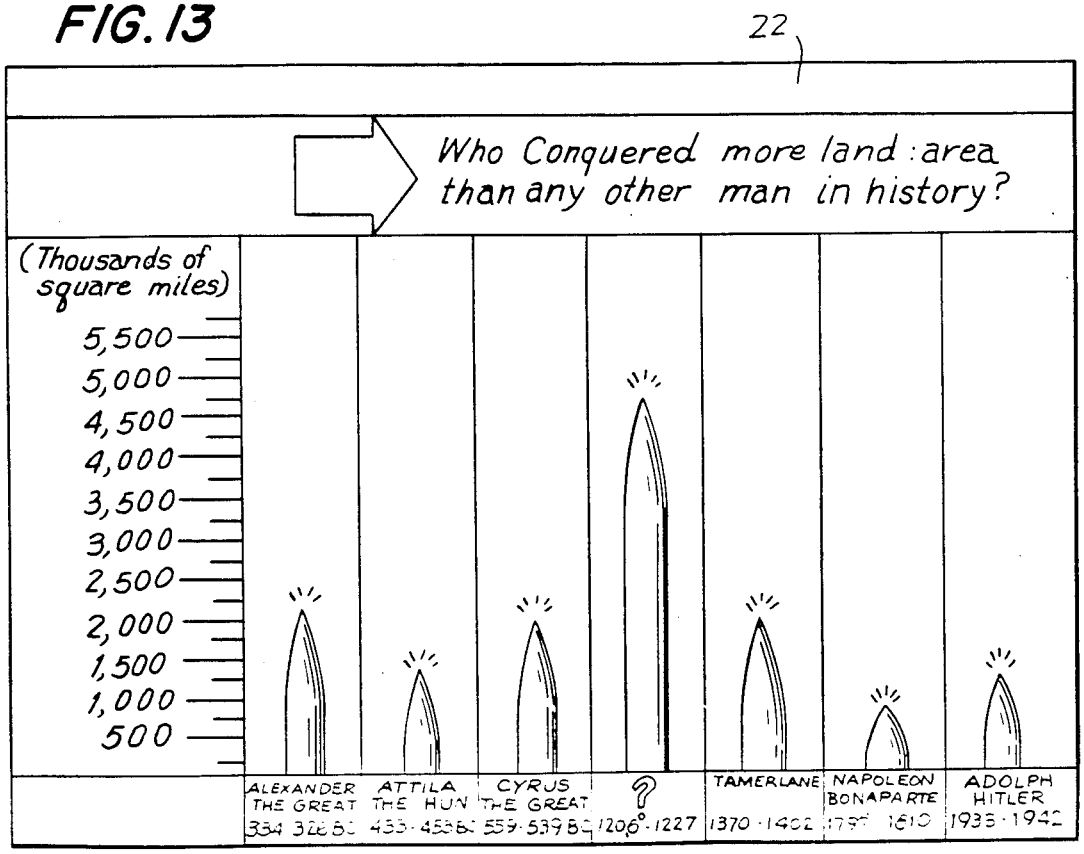
FIG. 13 is analogous to FIG. 6 showing another challenge card with another problem being presented for solution.
Figure 14:
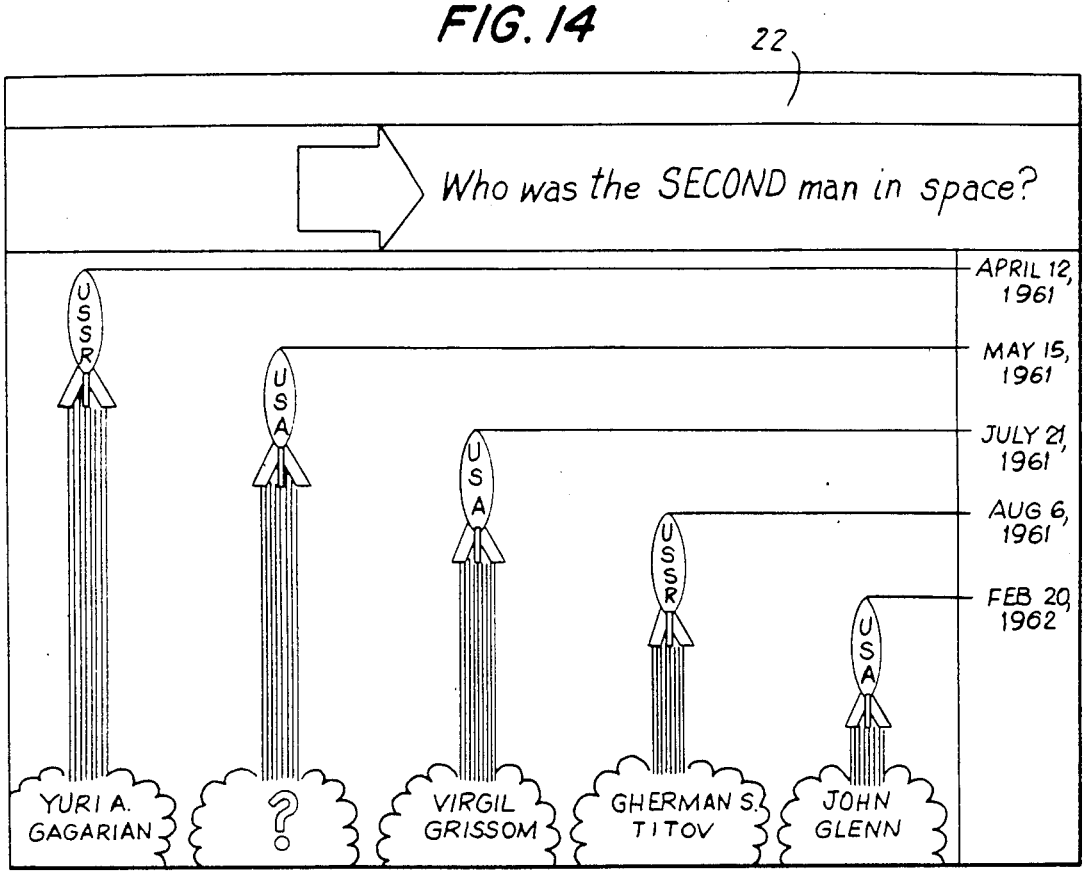
FIG. 14 is analogous to FIG. 6 showing another challenge card with a problem being presented for solution.
Figure 15:
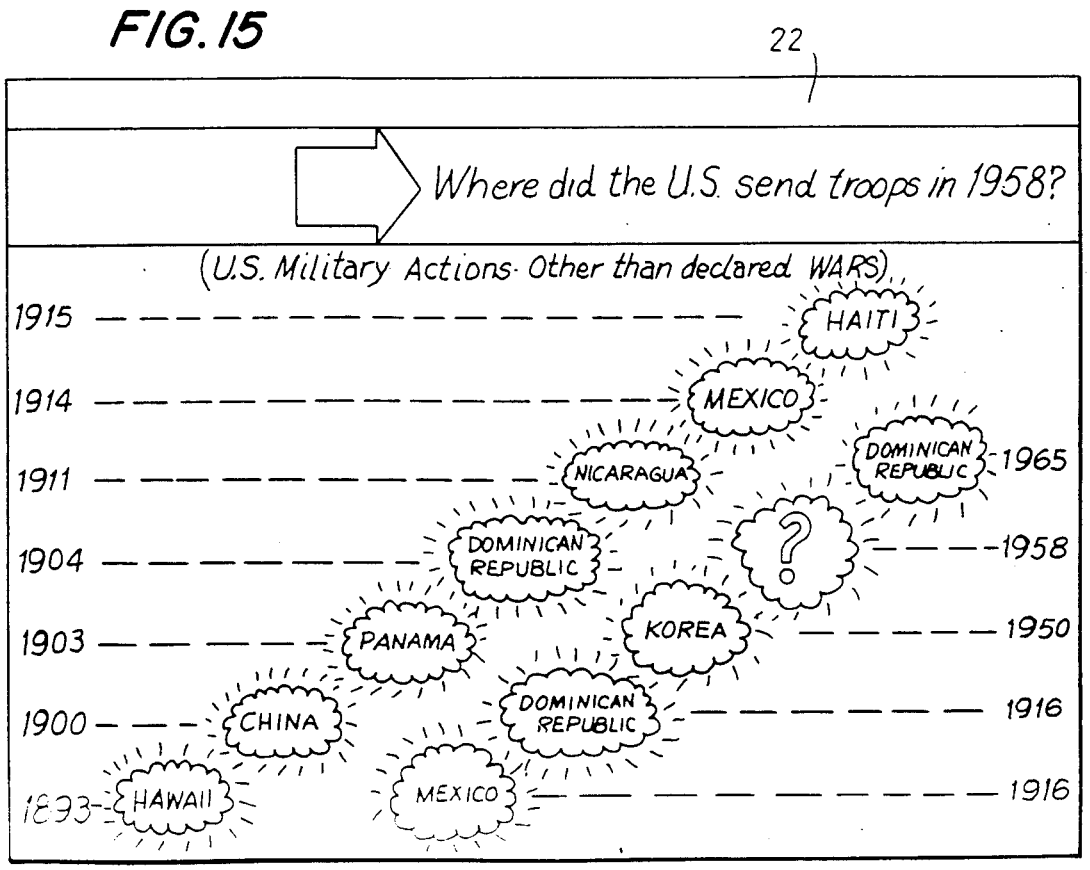
FIG. 15 is analogous to FIG. 6 showing another challenge card with another problem being presented for solution.
Figure 16:
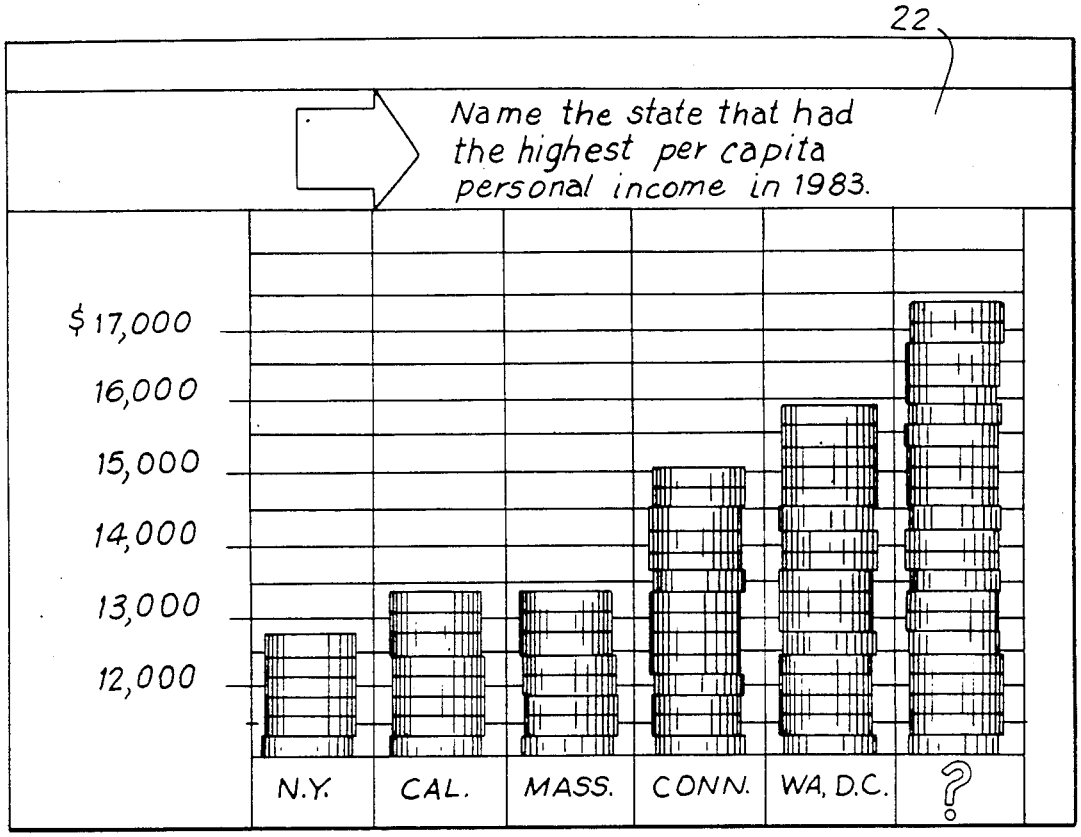
FIG. 16 is analogous to FIG. 6 showing another challenge card with another problem being presented for solution.
Figure 17:
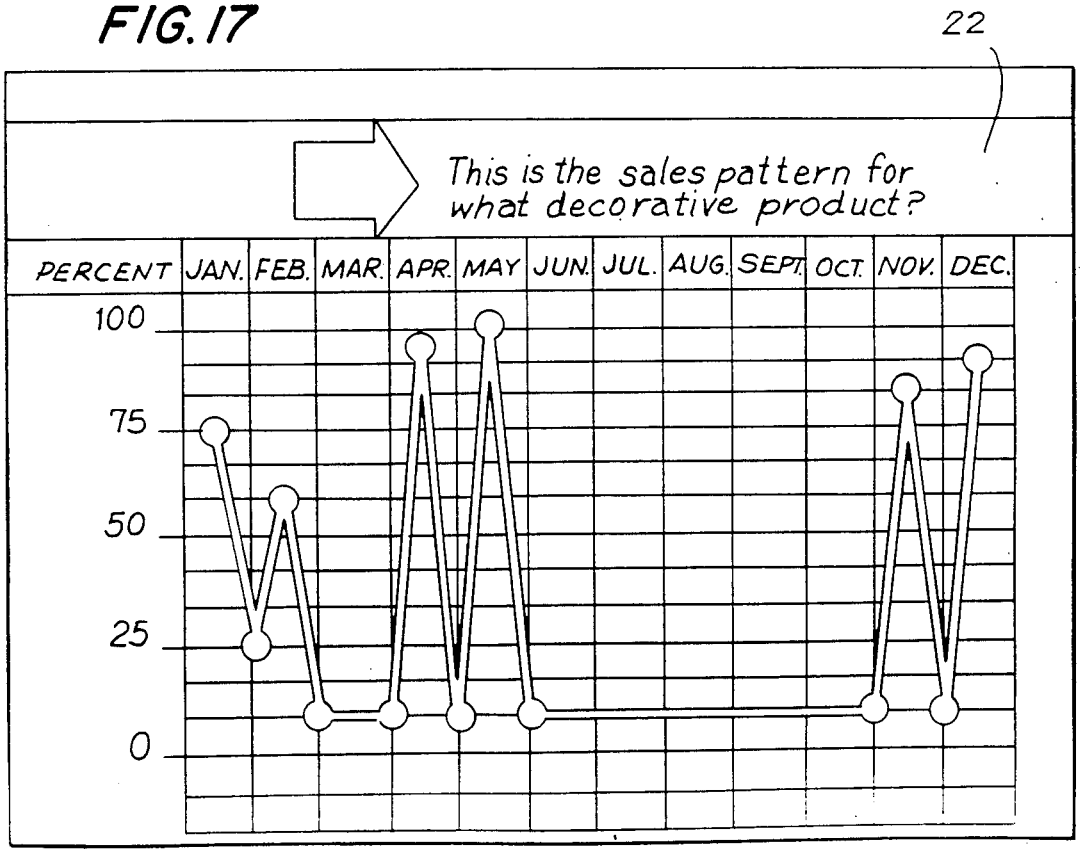
FIG. 17 is analogous to FIG. 6 showing another challenge card with another problem being presented for solution.
Figures 18, 19:
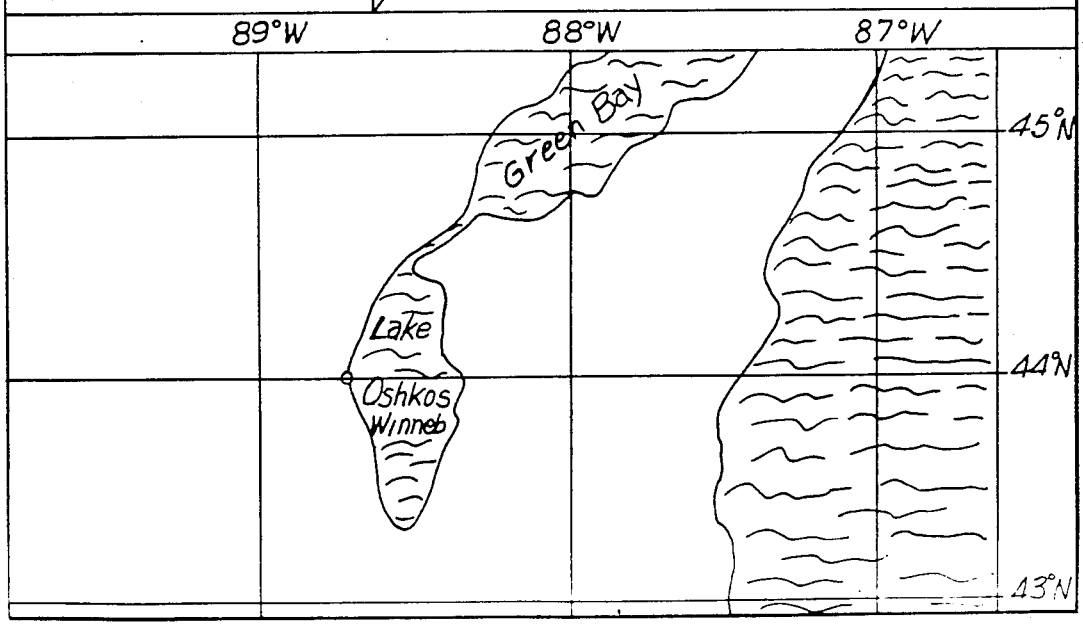
FIG. 18 is analogous to FIG. 6 showing another challenge card with another problem being presented for solution.
FIG. 19 is analogous to FIG. 6 showing another challenge card with another problem being presented for solution.
Figure 20:
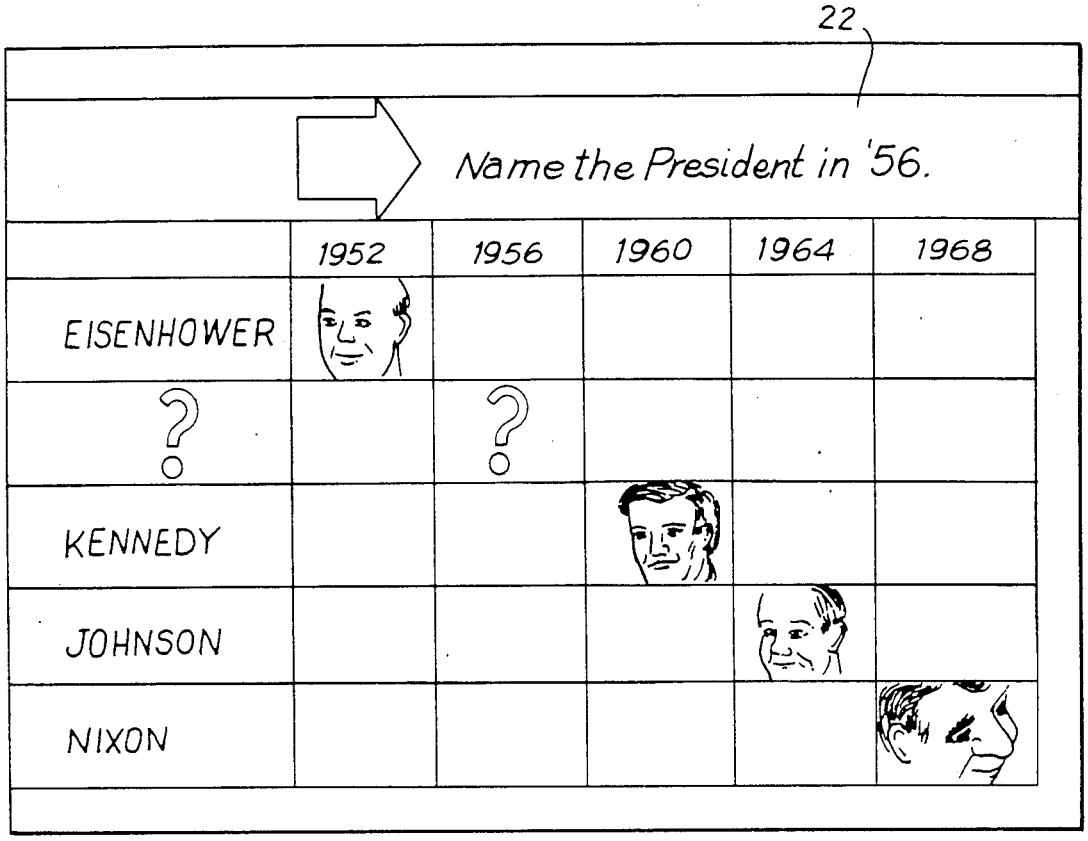
FIG. 20 is analogous to FIG. 6 showing another challenge card with another problem being presented for solution.
Figure 21:
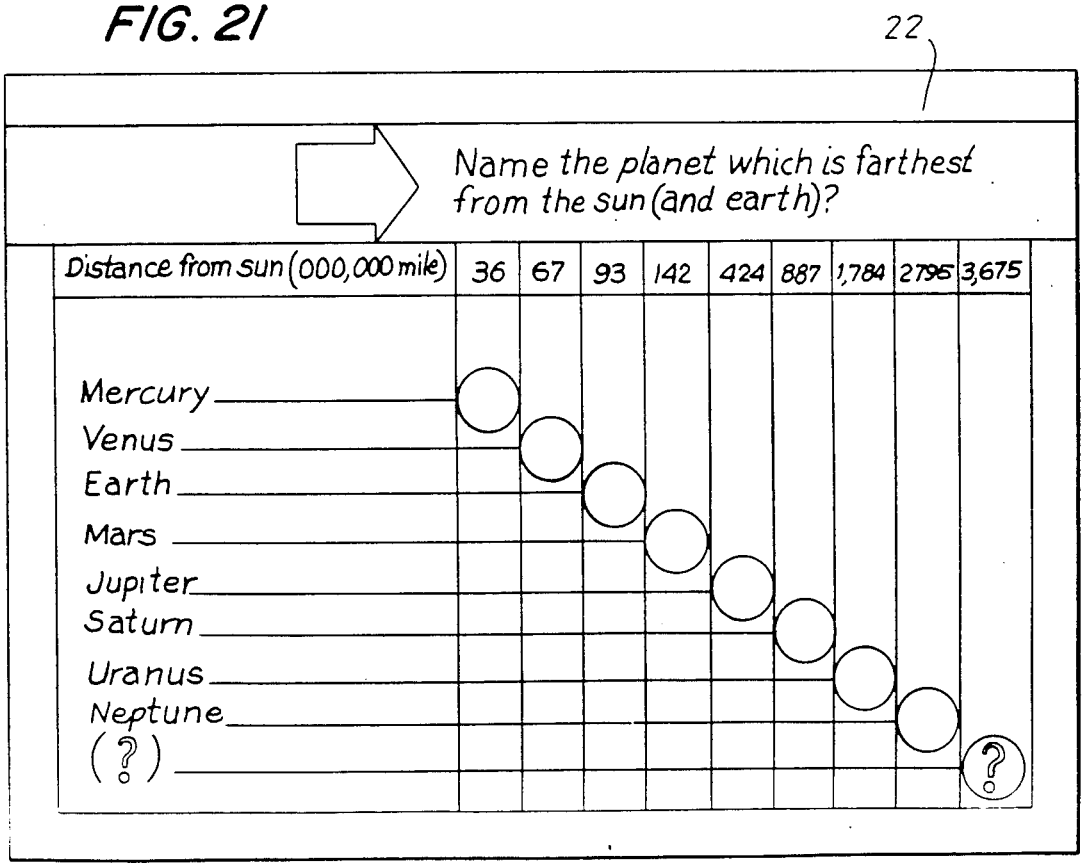
FIG. 21 is analogous to FIG. 6 showing another challenge card with another problem being presented for solution.
Figure 22:
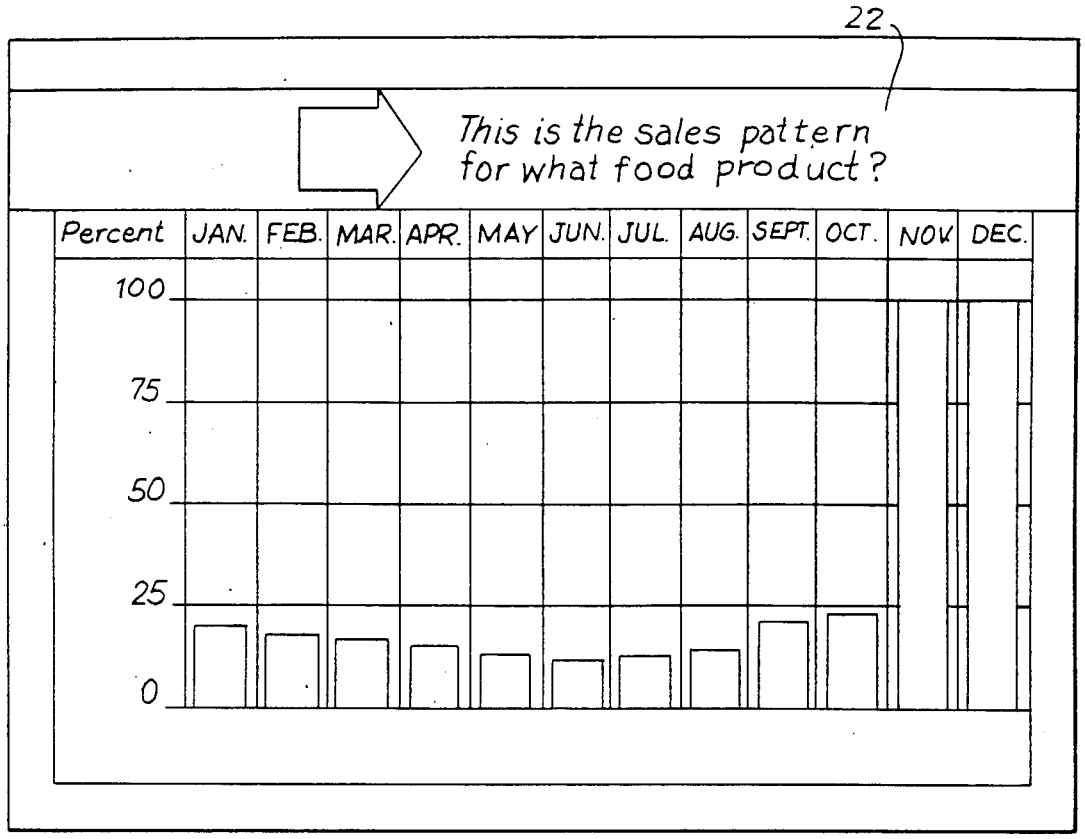
FIG. 22 is analogous to FIG. 6 showing another challenge card with another problem being presented for solution.
Figure 23:
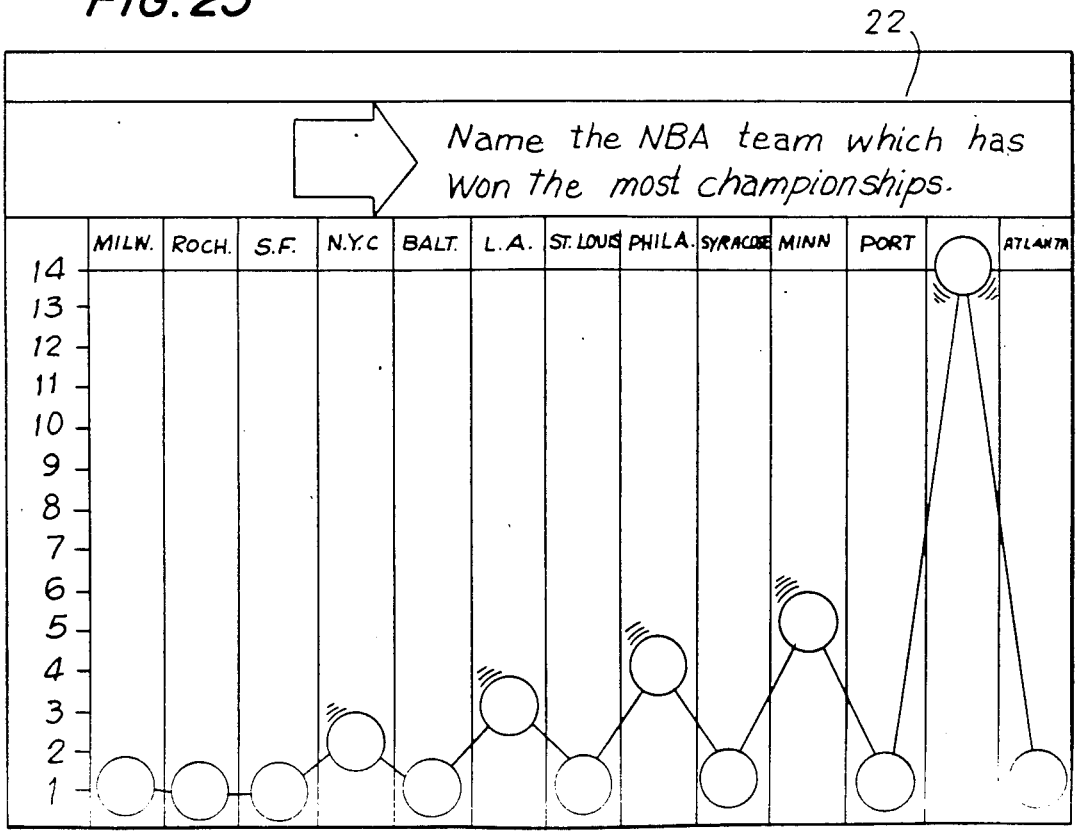
FIG. 23 is analogous to FIG. 6 showing another challenge card with another problem being presented for solution.

The challenge cards depicted in FIGS. 6–23 are meant to be examples of the types of problems included in the game. The problems are illustrated in chart-like format. To solve a problem requires deductive reasoning. For example, the problem shown in FIG. 8 asks the player to name the country in the world with the second highest population. If the player is not able to solve this problem initially, he is given a first clue, as shown in FIG. 9, "Cradle of passive resistance." If this does not help the player to correctly deduce the solution, he is given a second clue, "The jewel in the crown." Through deduction the player should realize that the correct answer to the problem is "India".

The amount of time allowed for solving each problem should be agreed by each group of players at the beginning of the game. If two or more players gain one hundred points (twenty chips) at the same time (after completion of a full round), the tied players are presented with as many additional Set A challenge cards as is necessary to break the tie. For the tie breaker rounds, bonus and penalty cards should not be used.

Winning the game depends upon a combination of both skill and chance. The primary element of the game is the ability to correctly deduce the answers to the problems presented on the challenge cards. However, the bonus and penalty cards interject an element of luck into the game. While the game is intended primarily as an entertainment device, it has the added benefit of being educational and helps to encourage and develop deductive reasoning.

While the invention has been illustrated and described as embodied in a game where players build vertical columns of slots by correctly solving problems, it is not to be limited to the details shown, since various modifications and structural changes may be made without departing in any way from the spirit of the present invention.

The invention should not be considered as limited by the specific embodiments shown and described, but only as limited in the appended claims.

What is claimed is:

1. A game in which players gain points by correctly solving problems, the game comprising:

scoring means comprising:

a plurality of vertical columns, each vertical column being defined by a plurality of slots;

a plurality of chips, each chip shaped and dimensioned to removably fit into said slots; and a plurality of challenge cards, each challenge card having a problem to be solved by a player and the correct solution to the problem thereon, players gaining points by correctly solving the problem, said points being indicated during play by chips retained in slots, wherein each vertical column is divided into three areas and wherein the challenge cards are divided into three sets, each set of challenge cards being associated with a different one of said three column areas, the first challenge card set including cards with easier to solve problems thereon, the second set including cards with problems more difficult to solve than those on the first set, and the third set including cards with problems more difficult to solve than those on the second set.

2. The game of claim 1 further comprising a playing board defining a flat playing surface upon which the columns can be placed.

3. The game of claim 3 further including a small turntable upon which the playing board can be placed for easy turning thereof.

4. The game of claim 1 further comprising three holding boxes, each holding box capable of holding one set of challenge cards.

5. A board game designed to stimulate a player's powers of deductive reasoning, the game comprising:

a flat game board;

a scoring means comprising six vertical columns, each of said columns being defined by twenty-one slots, each of said columns being divided into three areas;

six sets of chips, the chips in each set being of the same color but being of a different color from the chips in each other set, each set of chips being associated with a different one of said six vertical columns, each of said sets of chips including at least twenty chips;

three sets of challenge cards, each of said sets being associated with a different one of said three column areas, each challenge card having a first side with a problem to be solved thereon, and a second side having an answer to said problem and clues to aid in the solution of said problem thereon, the correct solution of problems providing players with points, said points being indicated during play by chips being retained in slots, the first set of challenge cards includes easier to solve problems, the second set of challenge cards including problems more difficult to solve then those in said first set, and the third set of challenge cards including problems more difficult than those in said second set;

a plurality of bonus and penalty cards which enable a player to gain or lose points without any problems being presented;

a small turntable for holding said board for easy rotation of same; and three boxes, each box capable of holding one of the sets of challenge cards.

* * * * *